US010371019B2

(12) United States Patent
Watanabe et al.

(10) Patent No.: US 10,371,019 B2
(45) Date of Patent: Aug. 6, 2019

(54) VALVE TIMING CONTROL DEVICE FOR INTERNAL COMBUSTION ENGINE

(71) Applicant: HITACHI AUTOMOTIVE SYSTEMS, LTD., Hitachinaka-shi, Ibaraki (JP)

(72) Inventors: Atsushi Watanabe, Nagareyama (JP); Shinichi Sato, Soma (JP)

(73) Assignee: HITACHI AUTOMOTIVE SYSTEMS, LTD., Hitachinaka-Shi (JP)

( * ) Notice: Subject to any disclaimer, the term of this patent is extended or adjusted under 35 U.S.C. 154(b) by 7 days.

(21) Appl. No.: 15/543,871

(22) PCT Filed: Nov. 27, 2015

(86) PCT No.: PCT/JP2015/083383
§ 371 (c)(1),
(2) Date: Jul. 14, 2017

(87) PCT Pub. No.: WO2016/114019
PCT Pub. Date: Jul. 21, 2016

(65) Prior Publication Data

US 2017/0370253 A1 Dec. 28, 2017

(30) Foreign Application Priority Data

Jan. 16, 2015 (JP) ..... 2015-006379

(51) Int. Cl.
*F01L 1/344* (2006.01)
*F01L 1/047* (2006.01)
*F01L 1/053* (2006.01)

(52) U.S. Cl.
CPC ..... *F01L 1/3442* (2013.01); *F01L 1/047* (2013.01); *F01L 1/053* (2013.01);
(Continued)

(58) Field of Classification Search
CPC ..... F01L 1/3442; F01L 1/047; F01L 2001/34423; F01L 2001/34479;
(Continued)

(56) References Cited

U.S. PATENT DOCUMENTS

2003/0226256 A1* 12/2003 Foster ..... B23P 19/042 29/888.01
2009/0288625 A1 11/2009 Toma et al.
(Continued)

FOREIGN PATENT DOCUMENTS

JP 2010-001770 A 1/2010
JP 2010-019146 A 1/2010
(Continued)

*Primary Examiner* — Mark A Laurenzi
*Assistant Examiner* — Wesley G Harris
(74) *Attorney, Agent, or Firm* — Foley & Lardner LLP

(57) ABSTRACT

A rear plate is provided which encloses an axial end opening of a housing body. A lock pin is configured to travel forward and backward in a slide hole formed in a first vane of a vane member, and an annular lock-hole-forming part is press-fitted to a retaining hole in an inner end surface of the rear plate, forming a lock hole in the rear plate. A projection having a flat distal end surface is formed at one circumferential end side of an inner peripheral surface of the lock-hole-forming part. Recesses that are continuous with the inner peripheral surface of the lock hole are formed on corresponding sides of the projection in the circumferential direction of the lock hole. This allows smooth engagement of the locking pin in the lock hole, and permits smooth supply and drainage of hydraulic pressure to and from the lock hole.

7 Claims, 11 Drawing Sheets

(52) U.S. Cl.
CPC ..... *F01L 2001/3443* (2013.01); *F01L 2001/34423* (2013.01); *F01L 2001/34453* (2013.01); *F01L 2001/34469* (2013.01); *F01L 2001/34479* (2013.01); *F01L 2001/34483* (2013.01); *F01L 2103/00* (2013.01); *F01L 2250/02* (2013.01); *F01L 2810/04* (2013.01)

(58) Field of Classification Search
CPC ..... F01L 2001/34469; F01L 2810/04; F01L 2250/02; F01L 1/053; F01L 2103/00; F01L 2001/34483; F01L 2001/34453; F01L 2001/3443
See application file for complete search history.

(56) References Cited

U.S. PATENT DOCUMENTS

| | | | | |
|---|---|---|---|---|
| 2010/0031906 | A1* | 2/2010 | Cuatt | F01L 1/3442 123/90.17 |
| 2011/0061616 | A1* | 3/2011 | Watanabe | F01L 1/02 123/90.15 |
| 2012/0285407 | A1 | 11/2012 | Watanabe | |
| 2013/0125845 | A1* | 5/2013 | Lin | F01L 1/3442 123/90.15 |
| 2014/0290605 | A1* | 10/2014 | Okazoe | F01L 1/3442 123/90.15 |
| 2015/0075461 | A1 | 3/2015 | Kato | |
| 2016/0281548 | A1* | 9/2016 | Betz | F01L 1/3442 |

FOREIGN PATENT DOCUMENTS

| | | | |
|---|---|---|---|
| JP | 2010-242532 | A | 10/2010 |
| JP | 2012-237196 | A | 12/2012 |
| JP | 2015-059518 | A | 3/2015 |

* cited by examiner

VALVE TIMING CONTROL DEVICE FOR INTERNAL COMBUSTION ENGINE

TECHNICAL FIELD

The present invention relates to a valve timing control device for an internal combustion engine, which is configured to control opening and closing timings of an engine valve variably depending on a state of operation of the internal combustion engine, wherein the engine valve is an intake valve or exhaust valve of the internal combustion engine.

BACKGROUND ART

A patent document 1 discloses a known conventional valve timing control device of a vane type provided at an intake valve side.

This valve timing control device includes a housing and a vane member, wherein the housing is configured to receive a torque transmitted from a crankshaft, and includes a housing body, a front plate, and a rear plate, wherein the front and rear plates enclose corresponding axial end openings of the housing body, wherein the vane member is rotatably mounted in the housing, and is fixed to an end portion of a camshaft. The housing includes a plurality of shoes in its inner peripheral surface, wherein each shoe projects inwardly in a radial direction, wherein an advance hydraulic chamber and a retard hydraulic chamber are defined between the plurality of shoes and a plurality of vanes.

The rotational position of the vane member relative to the housing is controlled to an advance side or a retard side by selective supply and drainage of hydraulic pressure to and from the advance hydraulic chamber and the retard hydraulic chamber depending on a state of operation of the engine.

When the engine is at rest, the rotational position of the vane member relative to the housing is locked in a most retarded position by a lock mechanism provided between the housing and a vane rotor.

The lock mechanism includes a lock pin and a lock hole, wherein the lock pin is configured to travel forward and backward in a slid hole formed in a first one of the vanes and extending in an axial direction of the first vane, and wherein a distal end portion of the lock pin is configured to engage in the lock hole formed in an inner side surface of the rear plate.

The lock mechanism is subject to a problem that the lock hole, in which the lock pin engages, has a circular cross-section so that during assembling components including the housing, the vane rotor, and the rear plate, positional deviation between the lock pin and the lock hole is likely to occur due to accumulation of many factors of tolerance.

Especially, if the inner diameter of the lock hole is set small in order to enhance the precision of a clearance between the outer periphery of the distal end of the lock pin and the lock hole, and thereby suppress noise of collision between the lock pin and the lock hole due to fluttering of the vane rotor in the state where the lock pin is engaged in the lock hole, it is possible that the lock pin fails to engage smoothly into the lock hole by contact between the lock pin and the edge of opening of the lock hole due to the positional deviation between the lock pin and the lock hole.

PRIOR ART DOCUMENT(S)

Patent Document(s)

Patent Document 1: JP 2012-237196 A

SUMMARY OF THE INVENTION

It is an object of the present invention to provide an internal combustion engine valve timing control device where operation of engagement and disengagement of a lock pin with a lock hole is improved because a projecting portion formed in an inner peripheral surface of the lock hole ensures the precision of a clearance between the lock pin and the lock hole in a rotational direction of a vane rotor while allowing positional deviation therebetween in a radial direction of the vane rotor, and allowing smooth supply and drainage of hydraulic pressure to and from the lock hole through sides of the projecting portion in a circumferential direction.

According to one aspect of the invention, a lock hole includes an inner peripheral surface including a projecting portion at least one of a first end side and a second end side of the inner peripheral surface in a circumferential direction of the vane member, wherein the projecting portion includes a distal end surface having a flat shape or an arc shape along a circumferential direction of the lock hole.

The present invention serves to ensure smooth engagement of the lock pin into the lock hole, while allowing smooth supply and drainage of hydraulic pressure to and from the lock hole.

BRIEF DESCRIPTION OF THE DRAWINGS

FIG. 11A shows an initial operation of the assembling process, FIG. 11B shows a second operation of the assembling process, and FIG. 11C is a major-part sectional view showing a final operation.

MODE(S) FOR CARRYING OUT THE INVENTION

Figure 1:
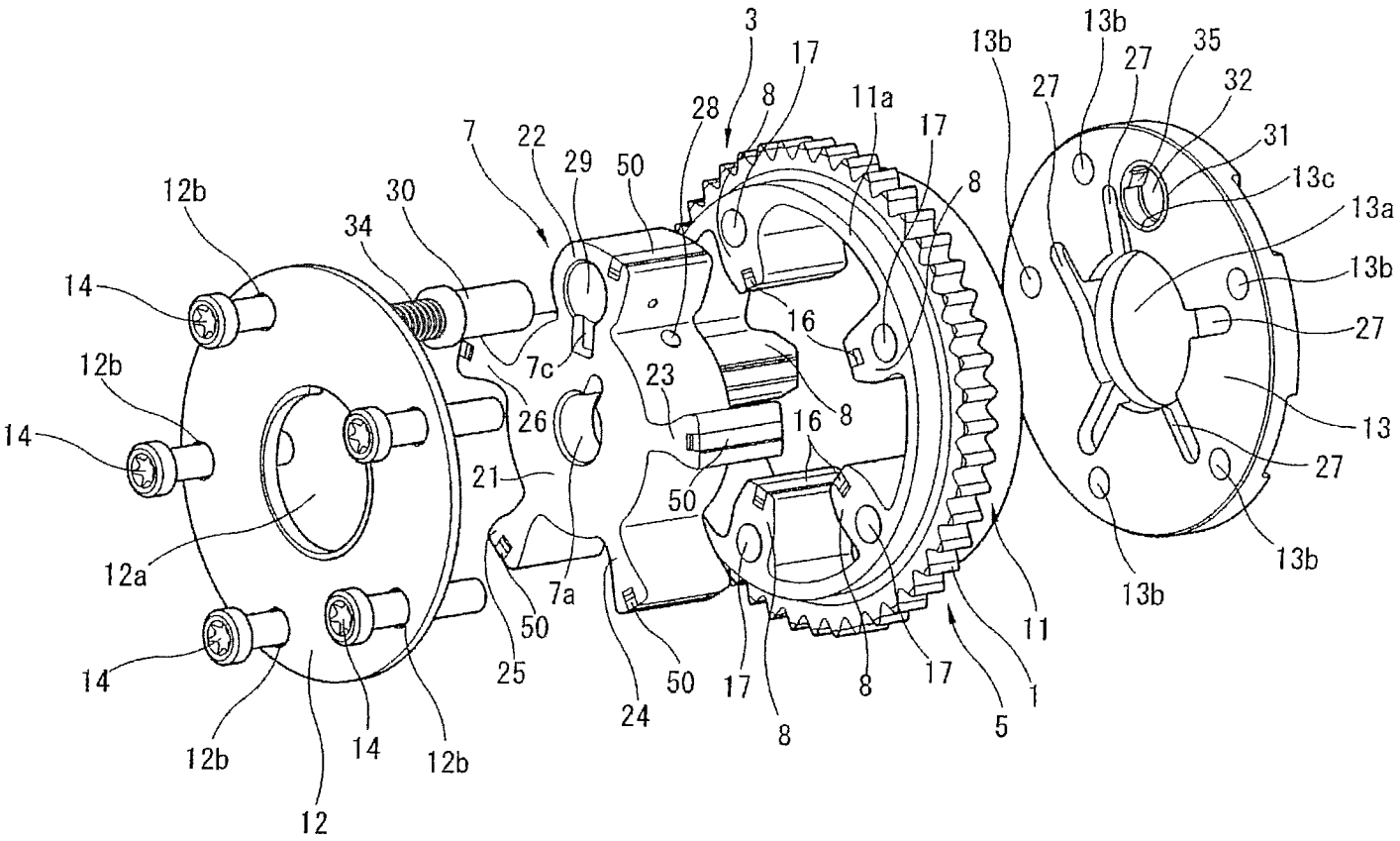
FIG. 1 is an exploded perspective view showing a valve timing control device according to a first embodiment of the present invention.

The following describes an internal combustion engine valve timing control device according to embodiments of the present invention with reference to the drawings.

First Embodiment

FIGS. 1-4 show a first embodiment in which a valve timing control device is provided at an intake valve side. The valve timing control device includes a sprocket 1, a camshaft 2, a phase-varying mechanism 3, and a hydraulic circuit 4, wherein sprocket 1 is a drive rotator configured to be rotated via a timing chain by a crankshaft not shown of an engine, wherein camshaft 2 is provided for rotation relative to sprocket 1, wherein phase-varying mechanism 3 is arranged between sprocket 1 and camshaft 2, and is configured to change a relative rotational position therebetween, and wherein hydraulic circuit 4 is configured to operate the phase-varying mechanism 3.

Camshaft 2 is rotatably supported by a cylinder head not shown via a cam bearing, and is provided integrally with a plurality of drive cams at specific positions in its outer peripheral surface for opening intake valves via valve lifters. Camshaft 2 includes a first end part 2*a* formed with an internally threaded hole 2*b* extending in its axial direction, where a cam bolt 6 is screwed in internally threaded hole 2*b* as described below.

Phase-varying mechanism 3 includes a housing 5, a vane member 7, five retard hydraulic chambers 9, and five advance hydraulic chambers 10, wherein housing 5 is arranged at a side of first end part 2*a* of camshaft 2, wherein vane member 7 is fixed to the first end part of camshaft 2 by the cam bolt 6 in the axial direction, and rotatably housed in housing 5, wherein five retard hydraulic chambers 9 and five advance hydraulic chambers 10 are formed in housing 5 and defined by five shoes 8 provided in an inner peripheral surface of housing 5 and five vanes 22-26 described below.

Housing 5 includes a housing body 11, a front plate 12, and a rear plate 13, wherein housing body 11 has a hollow substantially cylindrical shape where sprocket 1 is formed integrally with an outer peripheral surface of housing body 11, wherein front plate 12 and rear plate 13 enclose front and rear open ends of housing body 11, and wherein front plate 12 and rear plate 13 (sprocket 1) are integrally coupled to housing body 11 by common fastening of five bolts 14 in the axial direction.

Housing body 11 is formed integrally of a sintered metal material, and includes five shoes 8 which are arranged at substantially even intervals in the inner peripheral surface of housing body 11 in the circumferential direction of housing body 11, and configured to project inwardly. Each shoe 8 has a trapezoid shape (U-shaped in its side view), and is formed with a seal groove extending in the axial direction at the distal end portion, wherein a U-shaped seal member 16 is fitted and fixed in the seal groove, and is in sliding contact with an outer periphery of a rotor 21 of vane member 7. A bolt insertion hole 17 for insertion of each bolt 14 is formed to extend through the shoe 8 in the axial direction at an outer peripheral side of shoe 8 in the radial direction, namely, at a root portion side of shoe 8, wherein the root portion side is configured to be fixed to housing body 11.

Figure 3:
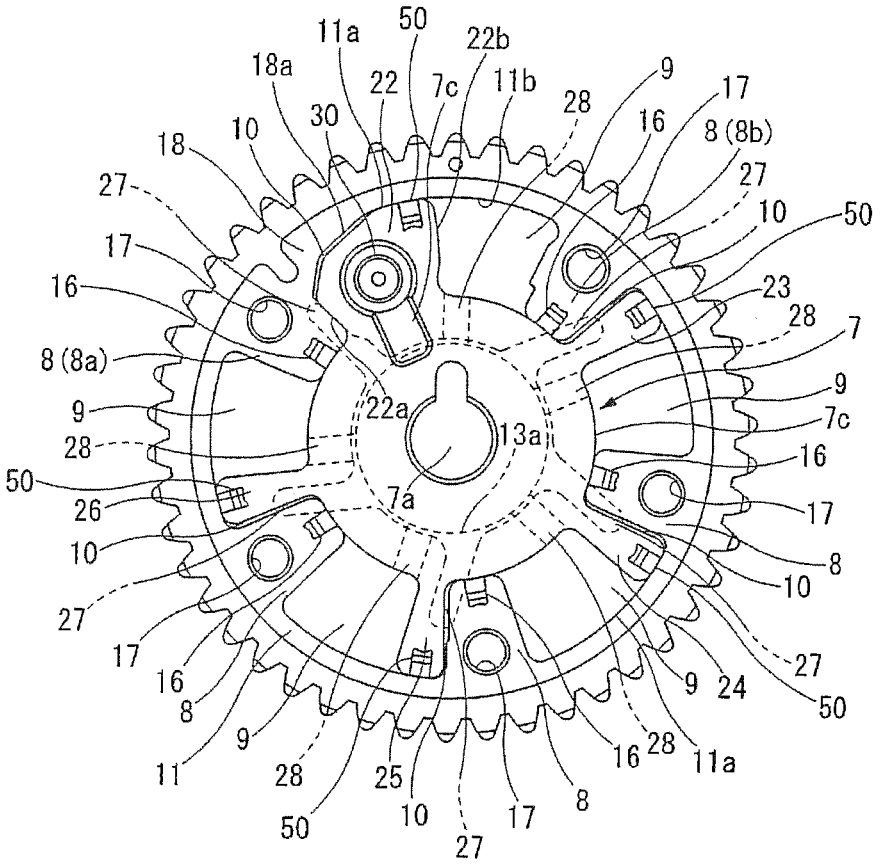
FIG. 3 is an operation illustration diagram showing a state where valve timing is controlled to a retard side according to the present embodiment.
Figure 4:
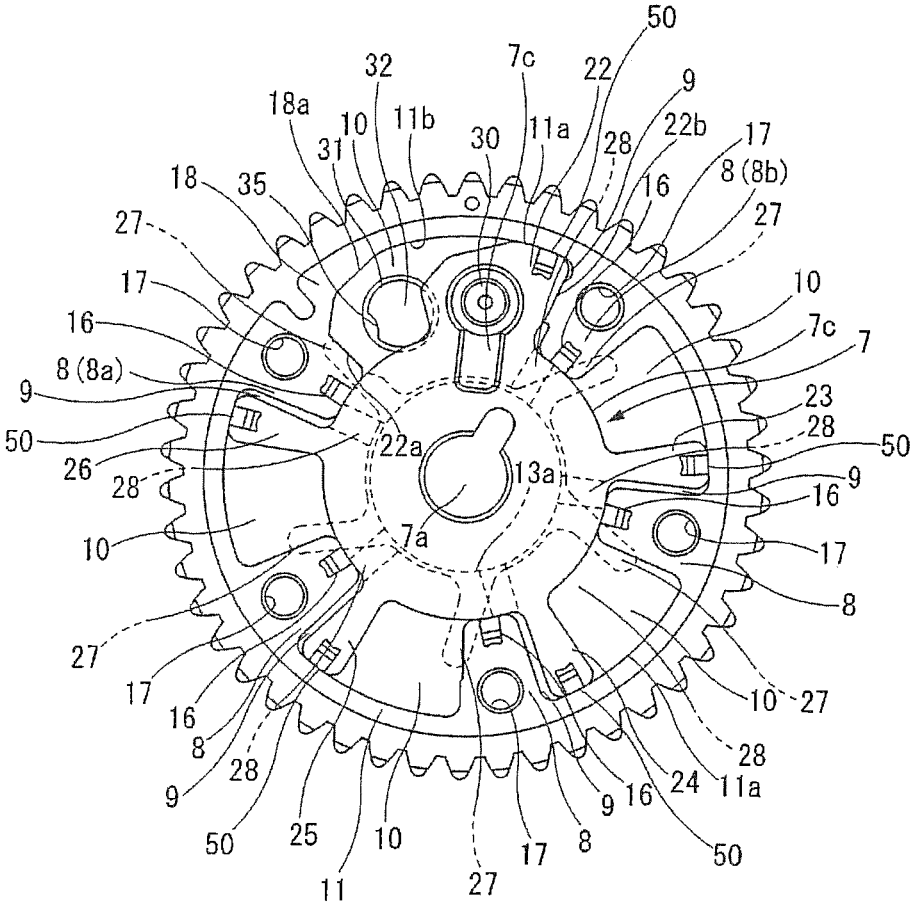
FIG. 4 is an operation illustration diagram showing a state where valve timing is controlled to an advance side according to the present embodiment.

Of five shoes 8, as shown in FIGS. 1, 3, 4, first shoe 8*a* is formed integrally with a thicker portion 18 at a first end side of the root portion in the circumferential direction, namely, at a right-side corner portion in FIG. 3.

The thicker portion 18 includes an inner peripheral surface 18*a* having a substantially arc shape or smoothly curved shape between a rising portion of a first side surface of first shoe 8*a* and an inner peripheral surface 11*b* of housing body 11.

Accordingly, the root portion of first shoe 8*a* has a higher strength than those of other shoes 8.

Front plate 12 is formed by press-forming into a relatively thin circular plate, and includes a large-diameter hole 12*a* at its central portion, wherein the cam bolt 6 is inserted in and through the large-diameter hole 12*a*. Front plate 12 includes five bolt insertion holes 12*b* in its outer peripheral side which are arranged at even intervals in the circumferential direction, wherein each bolt 14 is inserted in and through a corresponding one of bolt insertion holes 12*b*.

Rear plate 13 is formed of an iron-based metal into a relatively thick plate, and includes a support hole 13*a* at its central portion, wherein support hole 13*a* extends through the rear plate 13, wherein the first end part 2*a* of camshaft 2 is inserted in and rotatably supported by support hole 13*a*. Rear plate 13 includes internally threaded holes 13*b* in its outer peripheral side at even intervals in the circumferential direction, where an externally threaded portion of a distal end portion of each bolt 14 is screwed into a corresponding one of internally threaded holes 13*b*. Rear plate 13 is further formed with five advance-side oil holes 27 in its inner end surface facing the housing body 11, wherein each advance-side oil hole 27 communicates with the corresponding advance hydraulic chamber 10, and extends radially from the edge of opening of support hole 13*a*.

Figure 2:
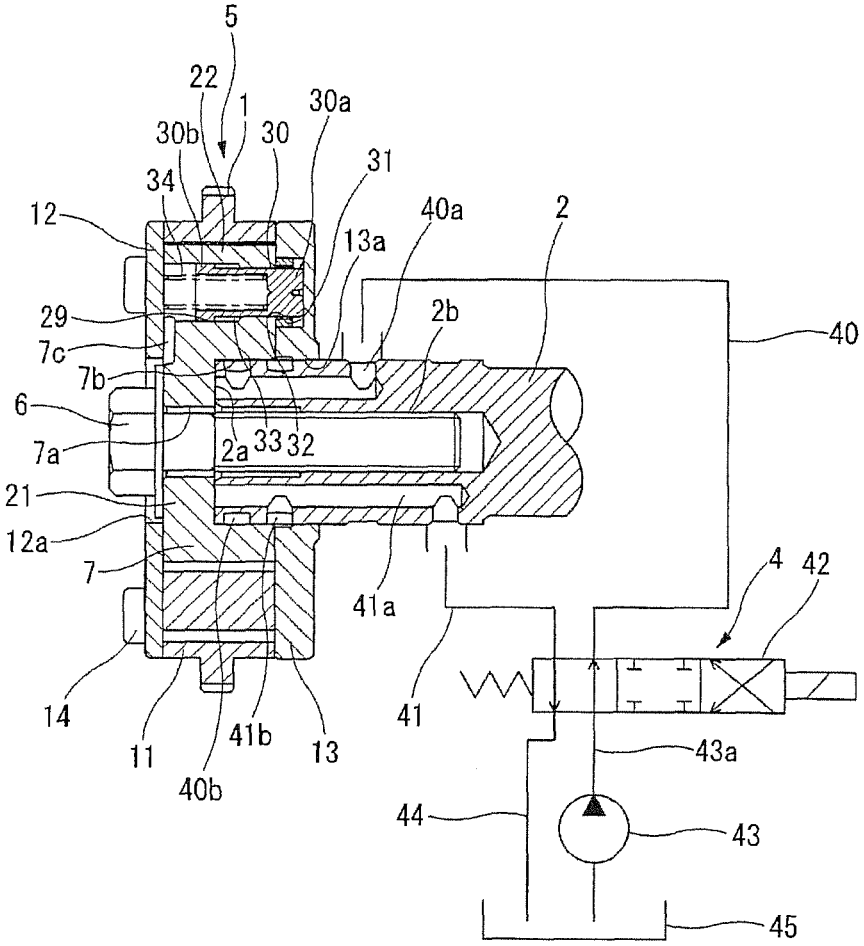
FIG. 2 is a schematic diagram showing a hydraulic circuit of the valve timing control device according to the present embodiment.

Vane member 7 is integrally formed of a metal material, and as shown in FIGS. 2 and 3, includes rotor 21 and five vanes 22-26, wherein rotor 21 is fixed to the first end part 2*a* of camshaft 2 by cam bolt 6 in the axial direction, wherein cam bolt 6 is inserted in the axial direction into a through hole 7*a* that is formed at the center of vane member 7 and extends through the vane member 7, wherein five vanes 22-26 are formed in an outer peripheral surface of rotor 21 at substantially even intervals in the circumferential direction, and configured to extend radially.

Rotor 21 is formed with a fitting recess 7*b* at the center, wherein fitting recess 7*b* has a cylindrical shape, and wherein the first end part 2*a* of camshaft 2 is fitted and supported in fitting recess 7*b*. Rotor 21 is rotatably supported in sliding contact with seal members 16 each of which is fitted and fixed on the upper surface of the distal end portion of each shoe 8. As shown in FIG. 3, sides of vanes 22-26 are formed with five retard-side oil holes 28 each of which extends through in the radial direction, and communicates with the corresponding retard hydraulic chamber 9.

Each vane 22-26 is disposed between corresponding two shoes 8 also as shown in FIG. 3, wherein a U-shaped seal member 50 is fitted in a seal groove formed in a distal end surface of vane 22-26, and is in sliding contact with the inner peripheral surface 11*b* of housing body 11, wherein the seal groove extends in the axial direction.

Of vanes 22-26, first vane 22 has a maximum width, while the other four vanes 23-26 have significantly smaller widths than first vane 22, wherein the widths of vanes 23-26 are substantially equal to each other.

When vane member 7 rotates maximally in the counter-clockwise direction as shown in FIG. 3, a first side surface of first vane 22 is brought into contact with the side surface of first shoe 8*a* facing the first side surface, thereby restricting the rotational position of vane member 7 relative to housing 5 at a most retarded position. When vane member 7 rotates maximally in the clockwise direction as shown in FIG. 4, a second side surface of first vane 22 is brought into contact with the side surface of second shoe 8*b* facing the second side surface, thereby restricting the rotational position of vane member 7 relative to housing 5 at a most advanced position.

When first vane 22 is in contact with first shoe 8*a* or second shoe 8*b*, each of the other vanes 23-26 is out of contact with any shoes 8 facing the each of the other vanes 23-26 in the circumferential direction.

Furthermore, a lock mechanism is provided between first vane 22 and rear plate 13, and is configured to restrict free rotation of vane member 7.

Figure 5:
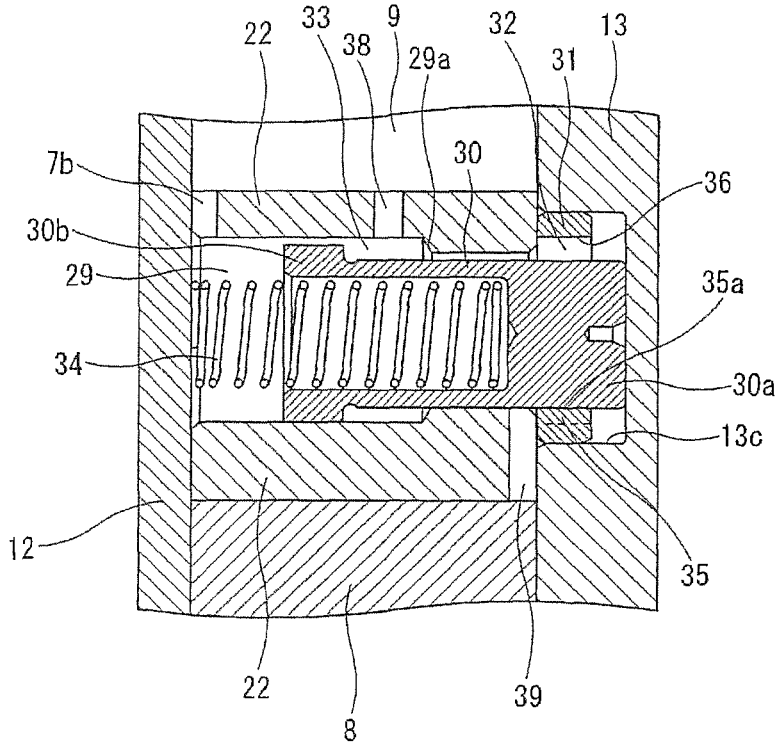
FIG. 5 is an enlarged sectional view showing a lock state made by a lock mechanism employed in the present embodiment.
Figure 6:
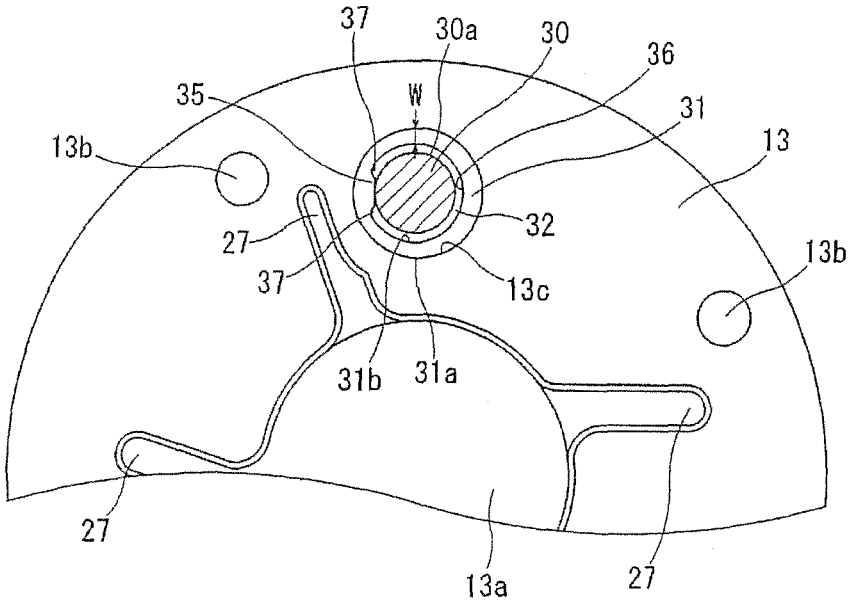
FIG. 6 is a front view showing a state where a lock pin is engaged in a lock hole formed in a rear plate employed in the present embodiment, including a sectional view part.

As shown in FIGS. 2, 3 and 5, the lock mechanism includes a lock pin 30, a lock hole forming part 31, a lock hole 32, and an engagement and disengagement mechanism, wherein lock pin 30 is slidably mounted in a slide hole 29, and is configured to travel forward toward rear plate 13 and backward, wherein slide hole 29 is formed in first vane 22, and extends through in the axial direction of first vane 22, wherein lock hole forming part 31 has an annular shape fixed in a retaining hole 13*c* formed in the inner end surface of rear plate 13 facing the housing body 11, wherein lock hole 32 is formed inside of lock hole forming part 31, and is configured to engage with the distal end portion 30*a* of lock pin 30, thereby locking the vane member 7, and wherein the engagement and disengagement mechanism is configured to cause the distal end portion 30*a* of lock pin 30 to engage in lock hole 32 or disengage from lock hole 32, depending on a state of start of the engine.

Slide hole 29 has an inner peripheral surface having a stepped shape including a portion having a larger diameter and a portion having a smaller diameter, namely, including a small diameter hole at its distal end side and a large diameter hole at its proximal end side, with an annular step portion 29*a* between the small diameter hole and the large diameter hole.

The distal end portion 30*a* of lock pin 30 has a non-hollow shape, and the whole of lock pin 30 is cylindrically shaped except for an annular portion 30*b* in the form of a flange formed in an outer periphery of its rear end, wherein a portion of lock pin 30 from annular portion 30*b* to the neighborhood of the distal end portion 30*a* in the axial direction has a hollow shape. The distal end portion 30*a* has a distal end edge that is chamfered and is thereby configured to be smoothly inserted and engaged in lock hole 32 of lock hole forming part 31.

Moreover, a pressure-receiving chamber 33 having a cylindrical tubular shape is formed between the step portion 29*a* of slide hole 29 and the annular portion 30*b* of lock pin 30.

The outer peripheral surface of distal end portion 30*a* may be formed to have a conical shape such that the distal end portion 30*a* can be easily engaged in lock hole 32.

The retaining hole 13*c* is formed in a predetermined position in the circumferential direction of rear plate 13, namely, in such a position that the distal end portion 30*a* of lock pin 30 is engaged in lock hole 32 via lock hole forming part 31 when vane member 7 is rotated to the most retarded position with respect to housing 5.

As shown in FIGS. 5 to 8, lock hole forming part 31 has an annular shape, and has a lateral thickness W uniform as a whole, and includes an outer peripheral surface 31*a* press-fitted and fixed to the inner peripheral surface of retaining hole 13*c*. Lock hole forming part 31 is integrally formed with a projecting portion 35 at a position in the left side of inner peripheral surface 31*b* in FIGS. 6 and 7, namely, at a position in the retard side of vane member 7, and is formed with an arc portion 36 of inner peripheral surface 31*b* opposite in the radial direction to projecting portion 35 of inner peripheral surface 31*b*.

Specifically, projecting portion 35 is formed in such a position that the outer peripheral surface of distal end portion 30*a* of lock pin 30 is brought into contact with projecting portion 35 in the rotational direction of vane member 7 when vane member 7 rotates to the most retarded position with respect to housing 5 depending on the position where retaining hole 13*c* is formed. Projecting portion 35 includes a distal end surface 35*a* that is flat and faces the lock pin 30. The flat distal end surface 35*a* is formed substantially perpendicular to the rotational direction of vane member 7 in lock hole 32. In other words, projecting portion 35 is formed substantially parallel to a plane connecting the rotational axis of vane member 7 and the center of lock hole 32 in the radial direction.

Figure 7:
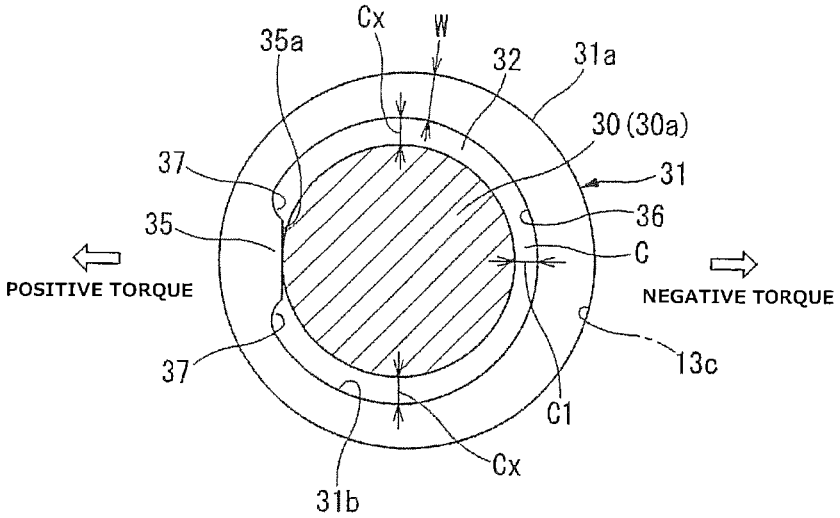
FIG. 7 is an enlarged view of a lock hole forming part and the lock hole shown in FIG. 6.

The distal end surface 35*a* is formed along a tangent of inner peripheral surface 31*b* of lock hole forming part 31, and has such an area that distal end surface 35*a* is constantly in contact with the outer peripheral surface of distal end portion 30*a* even when distal end portion 30*a* of lock pin 30 moves maximally in the vertical direction in lock hole 32 in FIG. 7.

A maximum projection quantity H of projecting portion 35 from an imaginary line defined by the radius of curvature of inner peripheral surface 31*b* of lock hole forming part 31 to distal end surface 35*a* is set such that when the outer peripheral surface of distal end portion 30*a* of lock pin 30 is in contact with distal end surface 35*a* of to projecting portion 35, a clearance C of about 60 μm is formed between the arc portion 36 of inner peripheral surface 31*b* opposite in the radial direction to projecting portion 35 of lock hole forming part 31 and the outer peripheral surface of distal end portion 30*a*, as shown in FIG. 7. The clearance C may be set within a range about from 30 μm to 90 μm.

Figure 9:
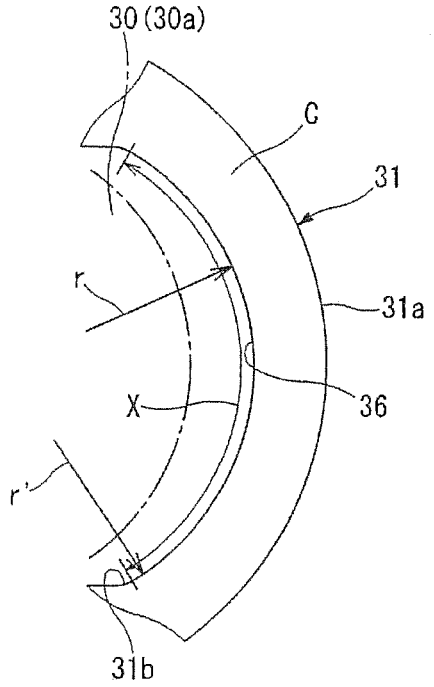
FIG. 9 is an enlarged view showing a part of an advance side of the lock hole forming part employed in the present embodiment.

As shown in FIG. 9, the arc portion 36 is formed to have an arc length X longer than an arc length of the right half of the outer peripheral surface of distal end portion 30*a* as shown in FIG. 9, and has a radius of curvature r that is smaller than a radius of curvature r' of lock hole forming part 31 and slightly larger than or substantially equal to the radius of curvature of distal end portion 30*a* of lock pin 30.

Accordingly, the inner peripheral surface of lock hole 32 is formed to have an elliptic shape based of the provision of arc portion 36.

Figure 8:
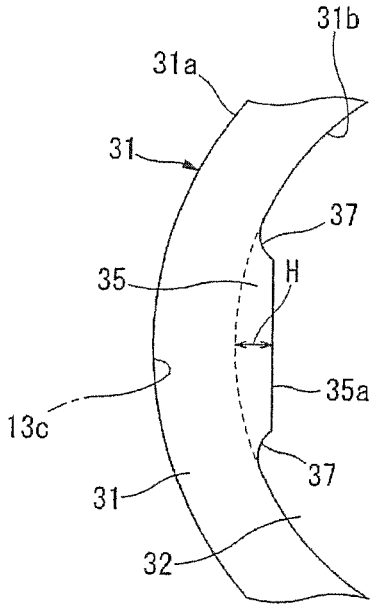
FIG. 8 is an enlarged view showing a part of a retard side of the lock hole forming part employed in the present embodiment.

As shown in FIG. 8, the projecting portion 35 is provided with a pair of recessed portions 37 on its sides in the circumferential direction, namely, on sides of projecting portion 35 in the circumferential direction of inner peripheral surface 31*b* of lock hole forming part 31. Each recessed portion 37 has an arc curved shape extending smoothly from distal end surface 35*a* of projecting portion 35 toward inner peripheral surface 31*b* and has an outer end edge smoothly continuous with inner peripheral surface 31*b*.

The lock hole 32 is formed in a position closer to the side of advance hydraulic chamber 10 in the circumferential direction (the retard side of vane member 7). This position corresponds to the position where retaining hole 13*c* is formed, and is such that the distal end portion 30*a* of lock pin 30 is locked in lock hole 32 when the rotational position of vane member 7 is in the most retard position with respect housing 5.

The inner surface of front plate 12 on the rear end side of slide hole 29 is formed with a rectangular cutout groove 7*c* which is communicated with the outside air and thereby is made to serve as an air vent hole to ensure preferable slide of lock pin 30 constantly.

The engagement and disengagement mechanism includes a coil spring 34 and a hydraulic circuit for disengagement not shown, wherein coil spring 34 is disposed in compressed state between the rear end portion of lock pin 30 and the inner end surface of front plate 12, and is configured to bias the lock pin 30 in the forward direction, wherein the hydraulic circuit for disengagement is configured to supply hydraulic pressure into lock hole 32 and pressure-receiving chamber 33, and thereby cause the lock pin 30 to travel backward. The hydraulic circuit for disengagement is configured to supply and drain hydraulic pressure to and from pressure-receiving chamber 33 and lock hole 32 via oil holes 38, 39 formed in the inside and the side surface of first vane 22, wherein the hydraulic pressure is supplied selectively to retard hydraulic chambers 9 and advance hydraulic chambers 10, as shown in FIGS. 3 to 5.

The hydraulic circuit 4 is configured to supply hydraulic pressure selectively to retard hydraulic chambers 9 and advance hydraulic chambers 10, or drain hydraulic pressure selectively from retard hydraulic chambers 9 and advance hydraulic chambers 10. As shown in FIG. 2, hydraulic circuit 4 includes: a retard-side passage 40 communicating with retard-side oil holes 28; an advance-side passage 41 communicating with advance-side oil holes 27; an oil pump 43 for supplying hydraulic pressure selectively to retard-side passage 40 and advance-side passage 41 via an electromagnetic switching valve 42; and a drain passage 44 communicating selectively with retard-side passage 40 and advance-side passage 41 via electromagnetic switching valve 42.

Passages 40, 41 communicate with oil holes 27, 28 via oil passage holes 40*a*, 41*a* and grooves 40*b*, 41*b* which are formed in camshaft 2 to extend in the radial direction and in the axial direction, respectively.

The electromagnetic switching valve 42 is a bidirectional valve, and is configured to perform a switching control for switching the passages 40, 41 to discharge passage 43*a* and drain passage 44 of oil pump 43 selectively, depending on an output signal from a controller not shown.

The controller includes an internal computer configured to sense a current state of operation of the engine based on input of informational signals from various sensors such as a crank angle sensor, an air flow meter, a coolant temperature sensor, and a throttle valve opening sensor not shown, and output a control current to an electromagnetic coil of electromagnetic switching valve 42 depending on the state of operation of the engine.

<Assembling Process for Valve Timing Control Device>

The following describes a process of assembling the valve timing control device, namely, assembling the vane member 7, the lock mechanism, front plate 12, rear plate 13, etc., to the housing body 11.

Figure 10:
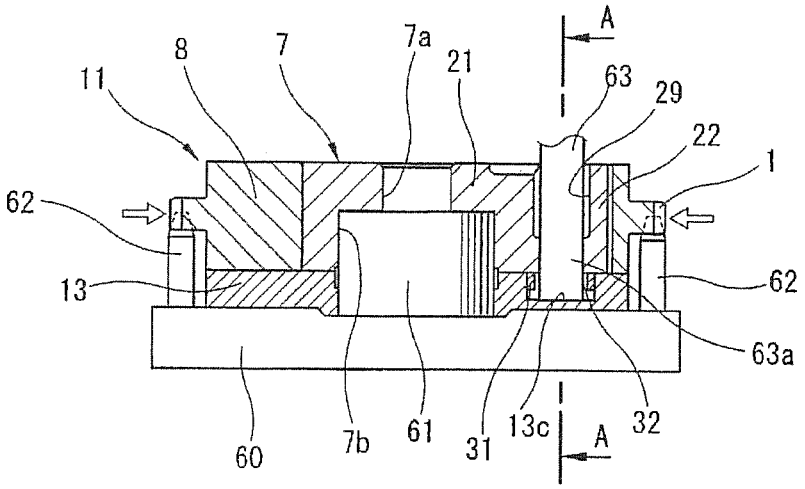
FIG. 10 is a sectional view showing a state where components of the valve timing control device according to the present embodiment are assembled.

First, as shown in FIG. 10, a camshaft-like jig 61 is fixed beforehand to a bottom surface having a circular recess formed substantially at a center of a top surface of a fixing base table 60, wherein camshaft-like jig 61 has a cylindrical shape having a large diameter.

Thereafter, rear plate 13, where lock hole forming part 31 is press-fitted in retaining hole 13*c* beforehand, is positioned while camshaft-like jig 61 is inserted through the support hole 13*a*, and rear plate 13 is mounted on the upper surface of fixing base table 60. Thereafter, housing body 11, in which vane member 7 is assembled beforehand, is mounted on the upper surface of rear plate 13. In this situation, vane member 7 is positioned in radial directions by engagement of camshaft-like jig 61 in fitting recess 7*b*. Moreover, in this situation, the position of slide hole 29 of vane member 7 and the position of lock hole 32 are suitably conformed to each other.

Under this condition, housing body 11 is fixed by being sandwiched inwardly in the radial direction (in the directions of arrows) by a plurality of fixing pins 62 projecting upwardly from the upper surface of the outer peripheral part of fixing base table 60. This restricts rotational movement of housing body 11, but allows rear plate 13 and vane member 7 to slidably rotate with respect to housing body 11.

Figure 11A:
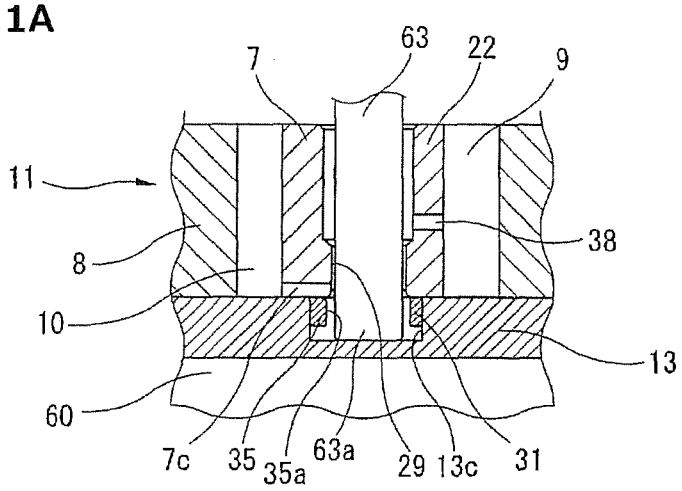
FIGS. 11A to 11C are sectional views taken along the line A-A in FIG. 10, where

Thereafter, as shown in FIGS. 10 and 11A, a distal end portion 63*a* of a lock-pin-like jig 63 having a cylindrical shape is inserted from above into slide hole 29 of vane member 7, and into lock hole 32. This conforms the axis of slide hole 29 to the axis of lock hole 32.

Figure 11B:
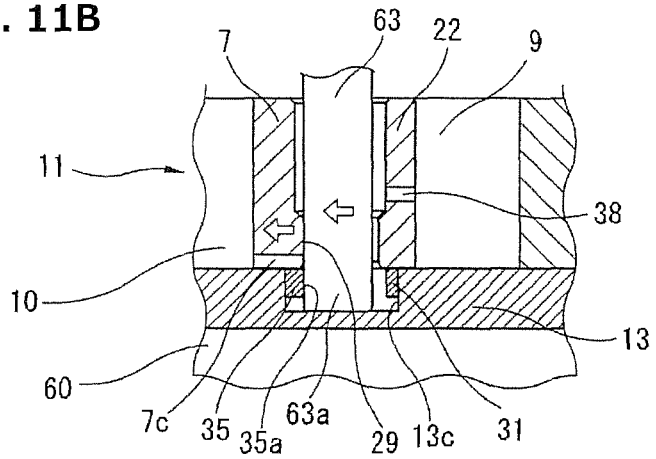

Next, as shown in FIG. 11B, vane member 7 and rear plate 13 are rotated together about camshaft-like jig 61 in the direction of arrows (in the retard direction), by using the lock-pin-like jig 63. This causes the distal end portion 63*a* of lock-pin-like jig 63 to travel within lock hole 32 in the same direction, and thereby causes the side surface of distal end portion 63*a* to be in contact with distal end surface 35*a* of projecting portion 35 of lock hole forming part 31. Then, one side surface of first vane 22 at the side of cutout portion 22*a* is brought into contact with the side surface of first shoe 8*a* facing the first vane 22.

Figure 11C:
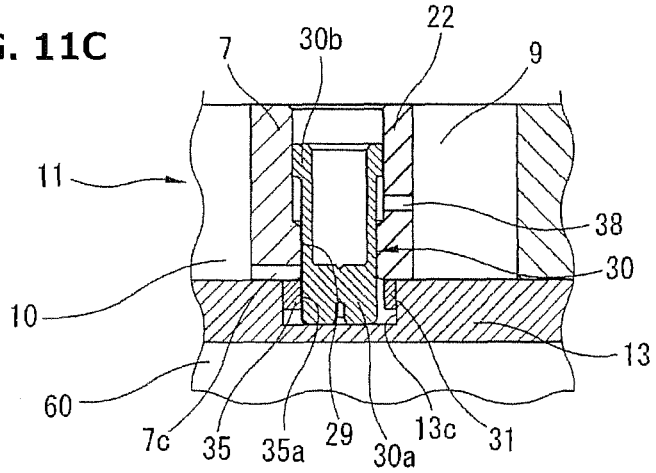

Under this condition, as shown in FIG. 11C, lock-pin-like jig 63 is drawn out of lock hole 32 and slide hole 29, and lock pin 30 is instead inserted into slide hole 29 and lock hole 32, and coil spring 34 is mounted from the rear end side of lock pin 30, and front plate 12 is made to cover the housing body 11 and the upper surface (side surface) of vane member 7 from above. In this situation, bolt insertion holes 12*b* of front plate 12 are conformed to bolt insertion holes 17 of housing body 11 in position, and bolts 14 are inserted into bolt insertion holes 12*b* and bolt insertion holes 17, and the male thread of the distal end portion of each bolt 14 is screwed and fixed into the corresponding internally threaded hole 13*b* of rear plate 13.

Thus, the process of assembling components of the valve timing control device is completed.

Operation of Present Embodiment

The following describes operations of the present embodiment. First, as shown in FIGS. 3 and 5, at start of the engine, the distal end portion 30*a* of lock pin 30 is engaged in lock hole 32 beforehand, to restrict the vane member 7 in the most retarded position optimal for starting of the engine. This produces preferable startability by smooth cranking, when an ignition switch is turned on to start the engine.

When the engine is in a predetermined region of operation after engine start, the controller energizes the electromagnetic coil of electromagnetic switching valve 42. This causes communication between discharge passage 43*a* of oil pump 43 and advance-side passage 41, and simultaneously causes communication between retard-side passage 40 and drain passage 44.

Accordingly, the working oil discharged from oil pump 43 flows through the advance-side passage 41 into advance hydraulic chambers 10 to apply high pressure to advance hydraulic chambers 10, while the working oil in retard hydraulic chambers 9 is drained through the retard-side passage 40 and drain passage 44 to oil pan 45 to supply low pressure to retard hydraulic chambers 9.

In this situation, the working oil flowing into advance hydraulic chamber 10 flows through the oil hole 39 into lock hole 32 to cause high pressure so that lock pin 30 is made via the annular portion 30*b* to travel backward, and the distal end portion 30*a* is released from lock hole 32, thereby ensuring free rotation of vane member 7.

As shown in FIG. 4, as the volumetric capacity of each advance hydraulic chamber 10 expands, vane member 7 rotates in the clockwise direction, to bring the projecting portion 22*b* of first vane 22 into pressing contact with the side surface of second shoe 8*b* facing the first vane 22, thereby restricting further rotation in the clockwise direction. This causes the rotation angle of vane member 7, namely, the rotation angle of camshaft 2, with respect to sprocket 1 (housing body 11), to shift to the most advanced side.

Next, when the engine shifts into another region of operation, the controller outputs a control current to electromagnetic switching valve 42, to cause communication between discharge passage 43*a* and retard-side passage 40, and simultaneously cause communication between advance-side passage 41 and drain passage 44. This drains the working oil out of advance hydraulic chambers 10 for low pressure, and supplies working oil into retard hydraulic chambers 9 for high internal pressure. In this situation, the hydraulic pressure is supplied from retard hydraulic chambers 9 to pressure-receiving chamber 33 through the oil hole 38, thereby maintaining the condition where lock pin 30 is released out of lock hole 32.

Accordingly, as shown in FIG. 3, vane member 7 rotates in the counterclockwise direction with respect to housing 5, to bring the side surface of first vane 22 at the side of cutout portion 22*a* into pressing contact with the opposite side surface of first shoe 8*a*, thereby restricting further rotation in the counterclockwise direction. This causes the rotational phase of camshaft 2 with respect to sprocket 1 to be in the most retarded position.

When the engine is in a state immediately before engine stop after the ignition switch is turned off, the hydraulic pressure in hydraulic chambers 9 and 10 is drained to oil pan 45 via the drain passage 44, to lower the hydraulic pressures of pressure-receiving chamber 33 and lock hole 32. This causes lock pin 30 to travel forward by the spring force of coil spring 34, and causes the distal end portion 30*a* to engage into lock hole 32, to lock vane member 7 with respect to housing 5, when vane member 7 is relatively rotated toward the most retarded side into the predetermined rotational position by alternating torque applied to camshaft 2.

In this situation, lock pin 30 can be smoothly engaged, because during assembling of the components described above, lock pin 30 and lock hole 32 are precisely positioned in the circumferential direction of housing 5.

Namely, in contrast to a conventional technique where assembling is performed with respect to a positioning pin, according to the process of assembling the components described above, vane member 7 and lock hole forming part 31 (rear plate 13) are rotated together to the retard side with respect to housing body 11 via the lock-pin-like jig 63 during assembling, thereby cancelling factors of the precision of angles of components such as vane member 7 and rear plate 13.

This serves to provide accurate positioning of lock pin 30 and lock hole 32 in the circumferential direction of housing 5, and thereby provide smooth engagement of the lock pin 30.

Furthermore, the configuration of the present embodiment that projecting portion 35 is provided in inner peripheral surface 31*b* of lock hole forming part 31, also serves to allow smooth engagement and disengagement of lock pin 30 with lock hole 32, and suppress the occurrence of fluttering between lock pin 30 and lock hole 32 (lock hole forming part 31) resulting from alternating torque applied to camshaft 2.

Specifically, if the inner peripheral surface of the lock hole is formed to have a circular shape, it is required, for suppression of fluttering of lock pin 30 with respect to lock hole 32, to enhance the precision of a clearance C1 (including the clearance C) between lock pin 30 and lock hole 32 in the rotational direction (circumferential direction) of vane member 7 shown in FIG. 7, and also enhance the precision of a clearance (Cx+Cx=C2) in the radial direction perpendicular to the clearance C1 in the circumferential direction, namely, it is required to reduce the inside diameter of lock hole 32 with respect to the outside diameter of distal end portion 30*a* of lock pin 30 as small as possible.

In that case, during assembling of the components, it is possible that when camshaft 2 is inserted in support hole 13*a* of rear plate 13 and in fitting recess 7*b* of vane member 7, slight deviation between rear plate 13 and vane member 7 causes a deviation of lock hole 32 relative to slide hole 29 in the radial direction, and thereby reduces the clearance C2 in the radial direction, so that during engagement or disengagement, the friction between the outer peripheral surface of distal end portion 30*a* of lock pin 30 and the inner peripheral surface of lock hole 32 becomes large, thereby preventing smooth engagement and disengagement.

In contrast, in the present embodiment, the provision of projecting portion 35 serves to reduce the clearance C1 in the circumferential direction, and the flat shape of distal end surface 35*a* of the projecting portion in the rotational direction serves to suppress the influence to clearance C1 even when rear plate 13 and vane member 7 are deviated in position in the radial direction so that the portion of the flat distal end surface 35*a* in contact with the distal end portion 30*a* of lock pin 30 is deviated.

Moreover, the use of the assembling process described above, in which during assembling, vane member 7 and lock hole forming part 31 (rear plate 13) are rotated together via lock-pin-like jig 63 with respect to housing body 11 to the retard side to bring the side surface of first vane 22 at the side of cutout portion 22*a* into contact with the side surface of first shoe 8*a* facing the first vane 22, serves to enhance the precision of positioning of first vane 22, first shoe 8*a*, and lock hole forming part 31 in the rotational direction of vane member 7 for the condition where vane member 7 is locked in the most retarded position.

Moreover, the assembling is made under the condition where the side surface of first vane 22 at cutout portion 22*a* is brought in contact with the opposite side surface of first shoe 8*a*, and the distal end portion 30*a* of lock pin 30 is brought into contact with distal end surface 35*a* of projecting portion 35, by lock-pin-like jig 63. This serves to reduce the clearance between the side surface of first vane 22 at the side of cutout portion 22*a* and the opposite side surface of first shoe 8*a* when vane member 7 is locked in the most retarded position. This serves to suppress noise of contact and striking between the side surface of first vane 22 at the side of cutout portion 22*a* and the opposite side surface of first shoe 8*a*, for example, even when vane member 7 is fluttering due to alternating torque applied to camshaft 2 in the state where lock pin 30 is engaged in lock hole 32 at engine start.

Furthermore, the feature that rear plate 13 and vane member 7 are assembled to camshaft-like jig 61 beforehand, serves to prevent deviation of positioning during fitting of camshaft 2. This allows to set relatively large the clearance C2 in the radial direction, and thereby ensure smooth engagement and disengagement of lock pin 30 with lock hole 32, and reduce the clearance C1 in the circumferential direction by provision of projecting portion 35, and thereby sufficiently suppress fluttering between the distal end portion 30*a* of lock pin 30 and lock hole 32 by the alternating torque of camshaft 2.

This fluttering-suppressing effect finally serves to sufficiently suppress the occurrence of striking noise between the outer peripheral surface of distal end portion 30*a* and the inner peripheral surface of lock hole forming part 31.

In the present embodiment, the feature that the whole of lock pin 30 including the distal end portion 30*a* has a uniform circular outline, serves to prevent lock pin 30 from being released unintentionally from lock hole 32, but provide stable engagement of lock pin 30 in lock hole 32, even when the distal end portion 30*a* of lock pin 30 is applied with a force in the shear direction due to the alternating torque of camshaft 2.

In the present embodiment, the feature that recessed portion 37 having an arc shape is formed on each side of projecting portion 35, serves to enhance response of release of lock pin 30 from lock hole 32, because at release of the locking, the working oil supplied to retard hydraulic chambers 9 and advance hydraulic chambers 10 is quickly supplied from pressure-receiving chamber 33 and oil hole 39 through recessed portions 37 to lock hole 32 (retaining hole 13*c*). This feature also serves to enhance response of locking of lock pin 30, because the working oil stored in lock hole 32 in the state of locking is drained quickly to pressure-receiving chamber 33 and oil hole 39 through recessed portions 37.

The further feature that the portion of inner peripheral surface 31*b* of lock hole forming part 31 opposite to projecting portion 35 in the radial direction is formed as arc portion 36, serves to reduce the contact pressure between the outer peripheral surface of distal end portion 30*a* and the arc portion 36 because the contact pressure is dispersed, even when in the lock state where lock pin 30 is engaged in lock hole 32, a negative component of the alternating torque in the direction of a white arrow is applied from camshaft 2 as shown in FIG. 7 to bring the outer peripheral surface of distal end portion 30*a* into collision contact with the arc portion 36. This serves to suppress the occurrence of striking noise, and suppress bear between the arc portion 36 and the distal end portion 30*a*.

In the present embodiment, in the state of most retarded angle, lock pin 30 is engaged in lock hole 32 so that the side surface of first vane 22 at the side of cutout portion 22*a* is in contact with the opposite side surface of first shoe 8*a*, and the distal end portion 30*a* of lock pin 30 is in contact with distal end surface 35*a* of projecting portion 35. Even when the outer peripheral surface of distal end portion 30*a* of the lock pin is brought into collision contact with the distal end surface 35*a* of projecting portion 35, this feature serves to disperse this contact pressure to the place of contact between the side surface of first vane 22 at the side of cutout portion 22*a* and the opposite side surface of first shoe 8*a*, and thereby reduce the overall contact pressure. This feature serves to disperse and reduce the contact pressure at the distal end surface 35*a* of projecting portion 35, although the distal end surface 35*a* of projecting portion 35 is formed flat so that the area of contact with the distal end portion 30*a* is small as compared to the arc portion 36.

In contrast to the conventional configuration that the lock hole has a circular shape and the whole of the inner peripheral surface 31*b* of lock hole forming part 31 needs to be formed by cutting, the provision of projecting portion 35 serves to shorten the time period of processing, because it is sufficient to process the distal end surface 35*a*.

Second Embodiment

Figure 12:
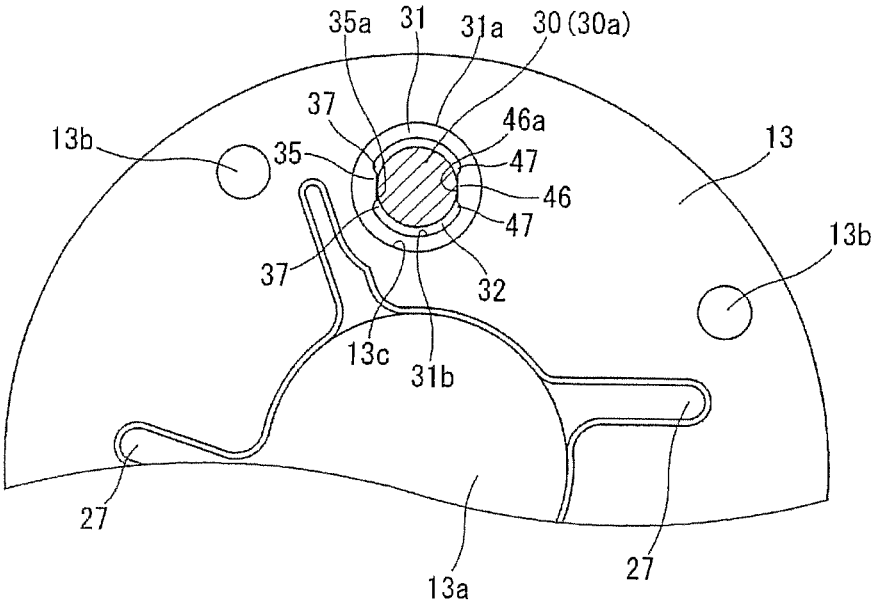
FIG. 12 is a front view showing a second embodiment of the present invention, showing a state where a lock pin is engaged in a lock hole formed in a rear plate, including a sectional view part.

FIG. 12 shows a second embodiment, which has the same basic configuration as the first embodiment, and differs from the first embodiment in that the arc portion 36 formed in the inner peripheral surface 31*b* of lock hole forming part 31 is replaced with a second projecting portion 46 formed in the position facing the projecting portion 35 in the radial direction.

Figure 13:
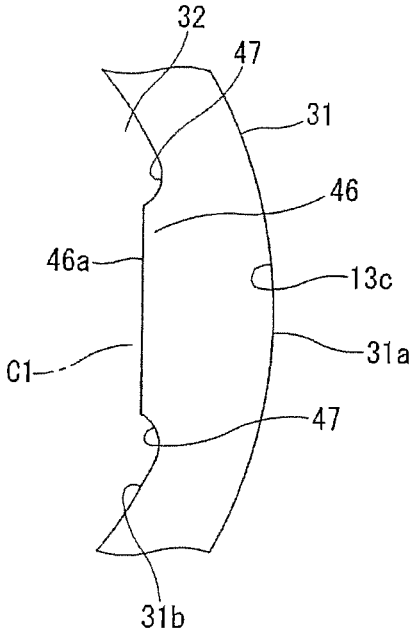
FIG. 13 is an enlarged view showing a part of an advance side of a lock hole forming part employed in the second embodiment.

As shown in FIG. 13, the second projecting portion 46 has the substantially the same configuration, i.e. lateral length, height, etc., as the projecting portion 35. The second projecting portion 46 includes a flat distal end surface 46*a* parallel to the distal end surface 35*a* of projecting portion 35, wherein second projecting portion 46 and projecting portion 35 form a width across flats. Second projecting portion 46 is provided with second recessed portions 47 on its sides, wherein each second recessed portion 47 has an arc shape. The second recessed portions 47 have the same configuration as first recessed portions 37, 37 in the first embodiment.

This embodiment where second projecting portion 46 is provided in addition to projecting portion 35 serves to restrict the clearance width between the outer peripheral surface of lock-pin-like jig 63 and each of distal end surfaces 35*a*, 46*a* of projecting portions 35, 46 when lock-pin-like jig 63 is inserted into lock hole 32 during the assembling process described in FIGS. 10 and 11. This allows to set the clearance C1 in the circumferential direction between lock hole 32 and lock pin 30 as desired, for example, to set the clearance C1 sufficiently small, even when the clearance C2 in the radial direction between lock hole 32 and lock pin 30 has a variation.

This serves to provide smooth engagement and disengagement of lock pin 30 with lock hole 32, and effectively suppress the occurrence of fluttering due to positive and negative components of the alternating torque of camshaft 2 in the lock state where lock pin 30 is engaged in lock hole 32.

The further configuration that second recessed portions 47 are formed on sides of second projecting portion 46 in addition to the provision of first recessed portions 37, 37, serves to further enhance the efficiency of supply of working oil from hydraulic chambers 9, 10 to lock hole 32, and further enhance the efficiency of drainage of working oil from lock hole 32.

Other operation effects are the same as in the first embodiment.

Third Embodiment

Figure 14:
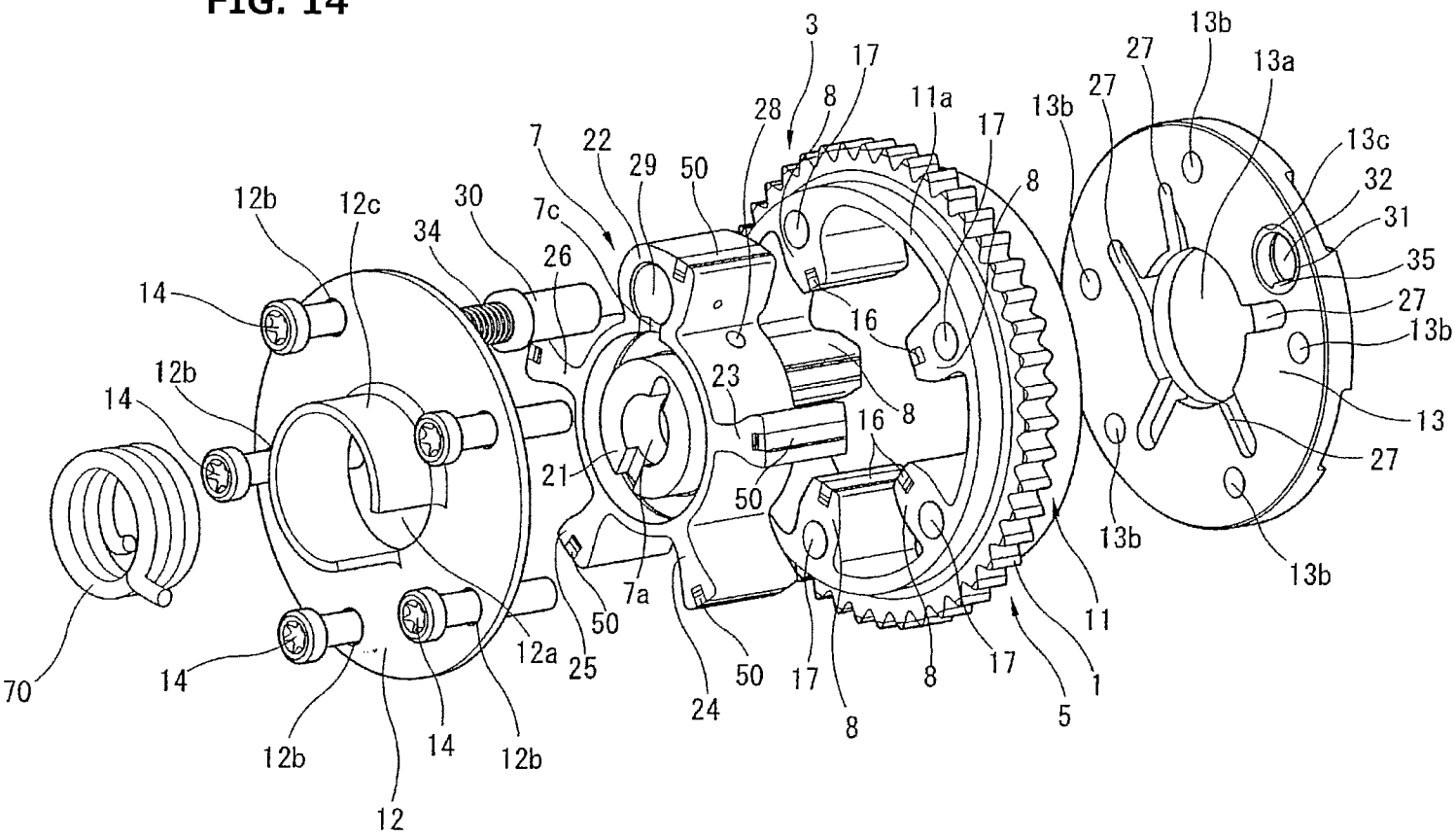
FIG. 14 is an exploded perspective view showing a valve timing control device according to a third embodiment of the present invention.

FIG. 14 shows a third embodiment of the present invention in which a valve timing control device is applied to an exhaust valve side, wherein basic configuration is similar to that of the first embodiment, where the same reference numbers are allocated to the same components and description thereof is omitted. The third embodiment differs from the first embodiment in that a torsion spring 70 is arranged at a cylindrical portion 12*c* formed integrally with the inner peripheral portion of front plate 12, and the portion of rear plate 13 where retaining hole 13*c* is formed is in a position where vane member 7 is relatively rotated to the most advanced side by the spring force of torsion spring 70.

Figure 15:
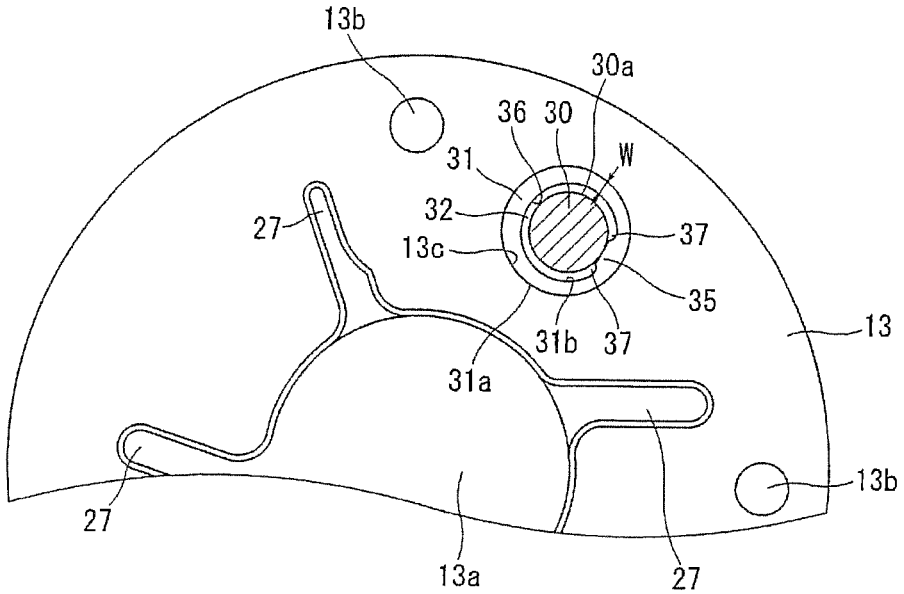
FIG. 15 is a front view showing a state where a lock pin is engaged in a lock hole formed in a rear plate, including a sectional view part.

As shown in FIG. 15, the lock hole forming part 31 press-fitted and fixed in retaining hole 13*c* is configured such that the projecting portion 35 is provided in a position in the advance side of inner peripheral surface 31*b* in contrast to the configuration of lock hole forming part 31 of the first embodiment. The other configuration is the same as in the first embodiment. Namely, the distal end surface 35*a* of projecting portion 35 is formed flat, and recessed portions 37 are formed on sides of projecting portion 35.

Moreover, the arc portion 36 is formed in a position (position of the retard side) opposite to projecting portion 35 in the radial direction, and the clearance C1 in the circumferential direction between the inner peripheral surface 31*b* of lock hole forming part 31 and the outer peripheral surface of the distal end portion 30*a* of lock pin 30 is set smaller than the clearance C2 in the radial direction.

Furthermore, the components are assembled by the operations shown in FIGS. 11A-11C as in the first embodiment.

Accordingly, the third embodiment also serves to accurately position the lock pin 30 and lock hole 32 in the circumferential direction of housing 5, and thereby provide smooth engagement and disengagement of lock pin 30 with lock hole 32 when vane member 7 is rotated to the most advanced position with respect to housing 5 by the spring force of torsion spring 70.

Furthermore, the configuration that the projecting portion 35 is provided in inner peripheral surface 31*b* of lock hole forming part 31, also serves to allow smooth engagement and disengagement of lock pin 30 with lock hole 32, and suppress the occurrence of fluttering between lock pin 30 and lock hole 32 (lock hole forming part 31) resulting from alternating torque applied to camshaft 2.

Other operation effects are the same as in the first embodiment.

Fourth Embodiment

Figure 16:
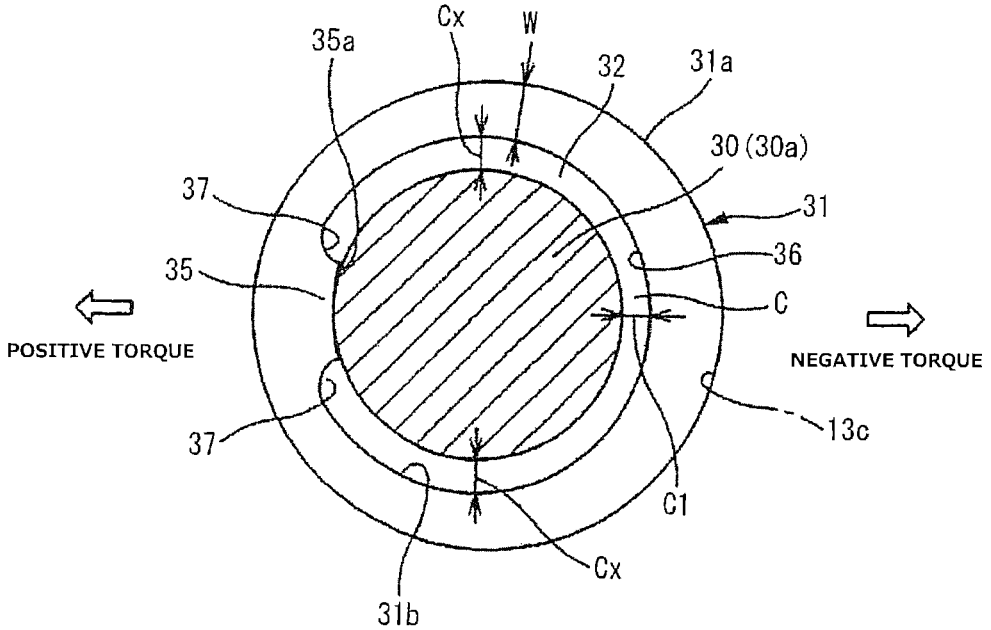
FIG. 16 is an enlarged view showing a fourth embodiment of the present invention, showing a state where a lock pin is engaged in a lock hole.

FIG. 16 shows a fourth embodiment, wherein basic configuration is the same to that of the first embodiment, but differs from the first embodiment in that the distal end surface 35*a* of projecting portion 35 provided in the inner peripheral surface 31*b* of lock hole forming part 31 is formed to have an arc shape along the outer peripheral surface of lock pin 30.

According to the present embodiment, this embodiment allows to set the clearance C1 in the circumferential direction between lock hole 32 and lock pin 30 as desired, for example, to set the clearance C1 sufficiently small, even when the clearance C2 in the radial direction between lock hole 32 and lock pin 30 has a variation. The further feature that the distal end surface 35*a* of projecting portion 35 is formed to have an arc shape, serves to reduce the contact pressure between the distal end portion 30*a* of lock pin 30 and the distal end surface 35*a* of projecting portion 35 upon contact therebetween. This serves to suppress the occurrence of striking noise, and suppress bear between the distal end surface 35*a* of projecting portion 35 and the distal end portion 30*a* of the lock pin.

In the present embodiment, the radius of curvature of distal end surface 35*a* having the arc shape is set larger than that of the outer periphery of distal end portion 30*a* of lock pin 30. This serves to suppress the clearance C1 from being influenced by positional deviation in the radial direction between vane member 7 and rear plate 13 during assembling.

The present invention is not limited to the configurations of the embodiments described above. For example, lock hole forming part 31 may be formed in an elliptic shape longer in the radial direction, not the circular shape, so that the clearance C1 with lock pin 30 in the circumferential direction is set smaller than the clearance C2 in the radial direction.

Sprocket 1, which is formed integrally with the outer periphery of housing body 11, may be replaced with a pulley. Furthermore, the sprocket 1 or pulley may be formed at the outer periphery of rear plate 13.

Lock hole 32 may be formed directly in retaining hole 13*c*, not formed by lock hole forming part 31. In this case, the projecting portion 35 and arc portion 36 are also formed directly in the inner peripheral surface of retaining hole 13*c*.

The invention claimed is:

1. An internal combustion engine valve timing control device comprising:

a housing body configured to receive a torque transmitted from a crankshaft, and include a plurality of operating chambers therein;

a vane member configured to:

be fixed to a camshaft;

include a plurality of vanes configured to separate the plurality of operating chambers and define an advance operation chamber and a retard operation chamber; and rotate to an advance side and a retard side selectively with respect to the housing body by selective supply and drainage of hydraulic pressure to and from the advance operation chamber and the retard operation chamber;

two enclosing plates configured to enclose corresponding axial end openings of the housing body;

a slide hole formed in one of the vanes, and configured to extend in an axial direction of the camshaft;

a lock member configured to travel forward and backward in the slide hole; and a lock hole formed in a side of a first one of the enclosing plates facing the operating chambers, wherein a distal end portion of the lock member is configured to engage in the lock hole;

wherein the lock hole includes an inner peripheral surface including a projecting portion on at least one of a first end side and a second end side of the inner peripheral surface in a circumferential direction of the vane member, wherein the projecting portion includes a flat distal end surface;

wherein the lock hole is formed with a recessed portion on each side of the projecting portion in a circumferential direction of the lock hole, wherein the recessed portion is continuous with the inner peripheral surface of the lock hole;

wherein the distal end portion of the lock member configured to engage in the lock hole is formed cylindrically; and wherein the lock hole is configured such that an inner surface of the lock hole facing the distal end surface of the projecting portion in a radial direction of the lock hole has an arc shape.

2. An internal combustion engine valve timing control device comprising:

a housing body configured to receive a torque transmitted from a crankshaft, and include a hollow shape, and include a plurality of shoes extending inwardly in a radial direction of the housing body;

a vane member configured to:

be fixed to a camshaft;

include a plurality of vanes configured to separate a plurality of operating chambers formed between a corresponding two of the plurality of shoes, and define an advance operation chamber and a retard operation chamber; and rotate to an advance side and a retard side selectively with respect to the housing body by selective supply and drainage of hydraulic pressure to and from the advance operation chamber and the retard operation chamber;

two enclosing plates configured to enclose corresponding axial end openings of the housing body;

a slide hole formed in one of the vanes, and configured to extend in an axial direction of the camshaft;

a lock member configured to travel forward and backward in the slide hole; and a lock hole formed in a side of a first one of the enclosing plates facing the operating chambers, wherein a distal end portion of the lock member is configured to engage in the lock hole;

wherein the lock hole includes an inner periphery including a projecting portion at least one of a first end side and a second end side of the inner periphery in a circumferential direction of the vane member, wherein the projecting portion includes a distal end surface having an arc shape along a circumferential direction of the lock hole.

3. The internal combustion engine valve timing control device as claimed in claim 2, wherein the lock hole is formed with a recessed portion on each side of the projecting portion in a circumferential direction of the lock hole, wherein the recessed portion is continuous with the inner peripheral surface of the lock hole.

4. The internal combustion engine valve timing control device as claimed in claim 3, wherein the distal end portion of the lock member configured to engage in the lock hole is formed cylindrically.

5. The internal combustion engine valve timing control device as claimed in claim 4, wherein the lock hole is configured such that a lateral distance between the distal end surface of the projecting portion having the arc shape and an inner surface of the lock hole facing the distal end surface of the projecting portion in a radial direction of the lock hole is smaller than a lateral distance between two inner surfaces of the lock hole that face each other and are located perpendicular to the projecting portion with respect to an axis of the lock hole.

6. The internal combustion engine valve timing control device as claimed in claim 5, wherein the lock hole is configured such that the inner surface of the lock hole facing the distal end surface of the projecting portion in the radial direction of the lock hole has a larger radius of curvature than an outer peripheral surface of the distal end portion of the lock member.

7. A process of assembling an internal combustion engine valve timing control device, the internal combustion engine valve timing control device comprising:

a housing body configured to receive a torque transmitted from a crankshaft, and include a hollow shape, and include a plurality of shoes extending inwardly in a radial direction of the housing body;

two enclosing plates configured to enclose corresponding axial end openings of the housing body;

a vane rotor configured to:

be fixed to a camshaft;

include a plurality of vanes configured to separate a plurality of operating chambers formed between a corresponding two of the plurality of shoes, and define an advance operation chamber and a retard operation chamber; and rotate to an advance side and a retard side selectively with respect to the housing body by selective supply and drainage of hydraulic pressure to and from the advance operation chamber and the retard operation chamber;

a slide hole formed in the vane rotor, and configured to extend in an axial direction of the camshaft;

a lock member configured to travel forward and backward in the slide hole, and include a substantially circular cross section; and a lock hole formed in a side of a first one of the enclosing plates facing the operating chambers, wherein a distal end portion of the lock member is configured to engage in the lock hole when the vane rotor is in one of a most advanced position, a most retarded position, and an intermediate position between the most advanced position or the most retarded position;

wherein the lock hole includes an inner peripheral surface including a projecting portion on at least one of a first end side and a second end side of the inner peripheral surface in a circumferential direction of the vane rotor, wherein the projecting portion includes a flat distal end surface;

the process comprising:

a first operation of fixing one of the housing body and the first enclosing plate, and holding the vane rotor and another of the housing body and the first enclosing plate together rotatably about an axis thereof;

a second operation of inserting a jig pin into the slide hole of the vane rotor, wherein the jig pin corresponds to the lock member;

a third operation of inserting a distal end portion of the jig pin into the lock hole by rotating the another of the housing body and the first enclosing plate, which is unfixed, with respect to the vane rotor;

a fourth operation of bringing an outer peripheral surface of the jig pin into contact with the distal end surface of the projecting portion by rotating the vane rotor in one direction with the outer peripheral surface of the jig pin in contact with an inner peripheral surface of the slide hole; and a fifth operation of drawing the jig pin out of the lock hole and the slide hole, and thereafter inserting the lock member into the slide hole and the lock hole.

* * * * *